US006416027B1

(12) United States Patent
Hart

(10) Patent No.: US 6,416,027 B1
(45) Date of Patent: Jul. 9, 2002

(54) APPARATUS FOR RETRACTING A TELEVISION TO A STORED POSITION AND EXTENDING THE TELEVISION TO A VIEWING POSITION

(76) Inventor: James K. Hart, 9030 Woodridge Dr., New Haven, IN (US) 46774

( * ) Notice: Subject to any disclaimer, the term of this patent is extended or adjusted under 35 U.S.C. 154(b) by 0 days.

(21) Appl. No.: 09/795,554

(22) Filed: Feb. 28, 2001

(51) Int. Cl.[7] ..... A47B 46/00

(52) U.S. Cl. ..... 248/324; 248/317; 248/324; 312/7.2; 312/248; 352/243; 296/37.7

(58) Field of Search ..... 348/317, 320, 348/324, 298.1, 284.1, 286.1; 296/37.7; 49/197, 199, 200

(56) References Cited

U.S. PATENT DOCUMENTS

| | | | | | |
|---|---|---|---|---|---|
| 4,750,832 | A | * | 6/1988 | Lloyd et al. | 352/104 |
| 4,829,725 | A | | 5/1989 | Gustaveson et al. | |
| 4,843,782 | A | | 7/1989 | Gustaveson et al. | |
| 4,941,718 | A | * | 7/1990 | Alexander et al. | 296/37.7 |
| 4,993,676 | A | | 2/1991 | Fitts et al | |
| 5,064,161 | A | | 11/1991 | Anderson | |
| 5,096,271 | A | * | 3/1992 | Portman | 244/118.5 |
| 5,148,282 | A | | 9/1992 | Sedighzadeh | |
| 5,181,771 | A | * | 1/1993 | Robak et al. | 185/40 R |
| 5,239,776 | A | * | 8/1993 | Lhotak | 49/199 |
| 5,261,645 | A | | 11/1993 | Huffman | |
| 5,501,042 | A | | 3/1996 | Gustaveson et al. | |
| 5,583,735 | A | * | 12/1996 | Pease et al. | 248/917 |
| 5,588,257 | A | * | 12/1996 | Duhame et al. | 49/199 |
| 5,743,487 | A | * | 4/1998 | Rice | 244/1 R |
| 6,073,892 | A | | 6/2000 | Dittmer | |

* cited by examiner

*Primary Examiner*—Leslie A. Braun
*Assistant Examiner*—Deborah M. Brann
(74) *Attorney, Agent, or Firm*—George Pappas

(57) ABSTRACT

An apparatus for supporting a flat bed television on a door mounted on a ceiling, or a cabinet which is mounted to a ceiling. The door and television are selectively pivoted between a retracted storage position and an extended television viewing position. Drive nut assemblies threadingly engage and are adapted to travel along drive screws which are rotatably driven by selectively reversible motors. Cables extend over guide wheels rotatably supported on the drive nut assemblies and extend and are connected to the door. As the drive nut assemblies are caused to travel along the drive screws, the cable lengths extending to the door are selectively lengthened and shortened for thereby selectively pivotally extending and retracting the door and television between the respective viewing and storage positions.

20 Claims, 3 Drawing Sheets

APPARATUS FOR RETRACTING A TELEVISION TO A STORED POSITION AND EXTENDING THE TELEVISION TO A VIEWING POSITION

TECHNICAL FIELD

The present invention relates to the technical field of apparatus for supporting televisions and for selectively retracting the television to a stored position and extending the television to a viewing position. More specifically, the present invention is directed to an apparatus wherein the television is carried on a pivoting door which is selectively pivoted for placing the television in a retracted stored position and an extended viewing position.

BACKGROUND OF THE INVENTION

In the past, in view of the size of televisions, there has been a desire to conceal them in a wall or ceiling and selectively extend them out therefrom for viewing. This is especially desirable and useful when a television is located in relatively small rooms or areas with a considerable amount of activity such as, for example, hospital rooms and recreation vehicles.

Prior apparatus for selectively extending and retracting televisions and/or projectors are disclosed in Dittmer U.S. Pat. No. 6,073,892 and Huffinan U.S. Pat. No. 5,261,645. Other solutions for selectively allowing a television to be viewed while recessing and/or storing it out from within the confines of the room include those disclosed in Gustaveson et al., U.S. Pat. Nos. 5,501,042, 4,843,782 and 4,829,725. In those patents, the television is stored in the ceiling or in a cabinet mounted on the ceiling and a door is selectively pivoted for either allowing the television to be viewed or hiding the television. A similar apparatus wherein the television is stored in a cabinet structure attached to a ceiling and a door is selectively moveable for viewing or hiding the television is disclosed in Sedighzadeh U.S. Pat. No. 5,148,282.

Although the prior apparatus generally function and accomplish their intended result, they are not without shortcomings and drawbacks. The apparatus wherein the televisions are selectively moved in and out of the ceiling or wall are typically very cumbersome, complex and not easily adapted for use in short ceilings. Further, the apparatus wherein the television is secured and a door is selectively moveable for allowing viewing generally require the television be viewed through a hole or tunnel, thereby making viewing more difficult and generally unpleasant. Accordingly, a need exists for an apparatus which efficiently and effectively moves a television from between a stored position in a ceiling or cabinet attached to a ceiling whereat the television is stored out of the way, to an extended viewing position whereat the television can easily be viewed.

SUMMARY OF THE INVENTION

It is the principal object of the present invention to overcome the above discussed disadvantages associated with prior apparatus for selectively retracting a television to a stored position and extending the television to a viewing position.

The present invention includes a door which is mounted to a ceiling or a cabinet mounted to a ceiling for pivoting between a retracted storage position and an extended viewing position. A flat bed television is mounted and carried on the door for pivotal movement therewith. When the door is retracted, the flat bed television is positioned generally horizontally facing upwardly and with the door closing the storage area within the ceiling or cabinet. When extended, the door and flatbed television are positioned generally vertically and extending downwardly from the ceiling, whereat the television screen is easily viewable from around the room. The apparatus includes left and right cables attached to the respective left and right sides of the door, whereby the door can be selectively pivoted upwardly to its retracted storage position and downwardly to its extended viewing position. The cables extend over guide pulleys and, at their other end, the cables are attached to the ceiling or cabinet near the door pivotal connection. The guide pulleys are mounted on drive nuts which threadingly engage respective left and right drive screws. The drive screws are selectively rotated clockwise and counter-clockwise about their longitudinal axis for thereby causing the drive nuts and guide pulleys to travel back and forth along the drive screws. The cable lengths are fixed and, thus, as the drive nuts and guide pulleys travel away from near the door pivotal connection, the cable length between the guide pulleys and the cable connection to the door is decreased, thereby causing the door to pivot upwardly and placing the door in the stored retracted position. For lowering the door to its viewing position, the drive screws are rotated in the opposite direction causing the drive nuts and guide pulleys to travel longitudinally along the guide screws in the opposite direction toward the door pivotal connection and the connection between the cables and the ceiling or cabinet. This causes the length of the cables between the guide pulleys and the cable to door connection to be increased and causing the door to be pivotally lowered by gravity and/or an additional spring to its generally vertical viewing position.

Preferably the drive screws are coupled through gearing to electric motors which are selectively energized to rotate clockwise or counter-clockwise, and thereby rotatably drive the drive screws. A coupling shaft extends and is connected between the electric motor rotor shafts for coupling and mechanically synchronizing the left electric motor and left drive screw with the right electric motor and right drive screw. Preferably the drive screws are provided with ACME threads for maximizing efficiency.

In one form thereof, the present invention is directed to an apparatus for selectively retracting a television to a stored position and extending the television to a viewing position. The apparatus includes a door mounted for pivoting between a retracted storage position and an extended viewing position. A television is carried on the door. A drive nut threadingly engages a drive screw and the drive screw is selectively rotatable for thereby causing the drive nut to travel along the drive screw. A cable cooperates with the door and the drive nut for selectively pivoting the door and television between a retracted storage position and an extended viewing position.

In one form thereof the present invention is directed to an apparatus for selectively retracting a television to a stored position and extending the television to a viewing position. The apparatus includes a door having a left side, a right side and an upper side. The door is mounted along its upper side for pivoting between a retracted storage position and an extended viewing position. A television is carried on the door. A left drive nut threadingly engages a left drive screw and a right drive nut threadingly engages a right drive screw. The left and right drive screws are selectively rotatable for thereby causing the respective drive nuts to travel along the drive screws. A left cable is attached to the door generally near the door left side and a right cable is attached to the door generally near the door right side. The left cable cooperates with the left drive nut and the right cable cooperates with the right drive nut for selectively pivoting the door and television between a retracted storage position and an extended viewing position.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Figures 1, 2:
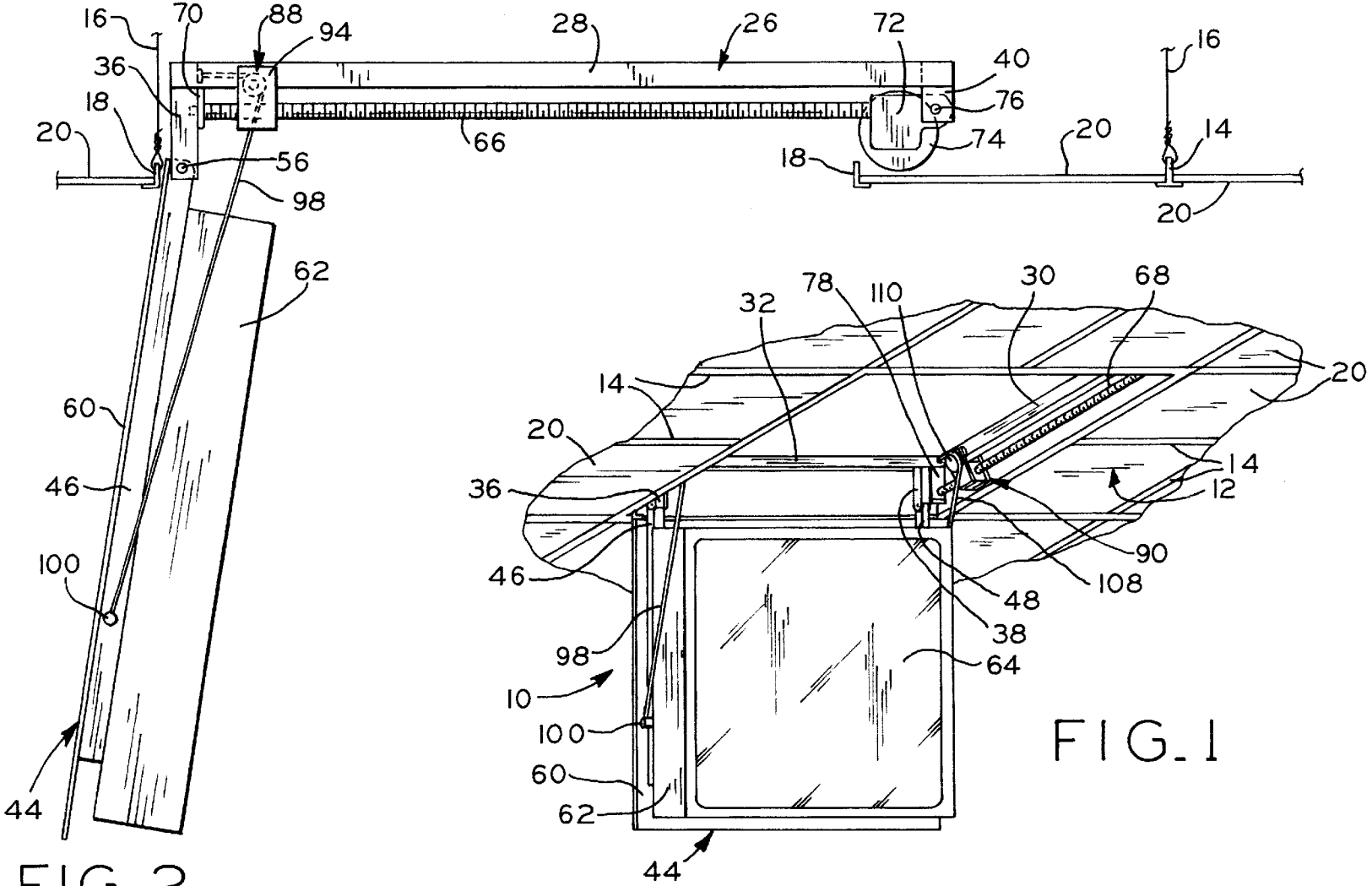
FIG. 1 is a perspective view of an apparatus constructed in accordance with the principles of the present invention and showing the door and television in the extended viewing position below a ceiling.
FIG. 2 is a side and partial cross sectional view of the apparatus shown in FIG. 1 depicting the apparatus mounted in the ceiling and the door extended to its viewing position.

Referring initially to FIG. 1, an apparatus constructed in accordance with the principles of the present invention is shown and generally designated by the numeral 10. Apparatus 10 is adapted for and is used by mounting and being supported on a ceiling such as ceiling 12 shown in FIGS. 1 and 2. Exemplary ceiling 12, as shown, is a grid type ceiling including T members 14 supported with wire 16 and comer pieces 18 adapted together to support lay-in panels 20. Another exemplary ceiling is shown in FIGS. 3 and 5 wherein a contiguous solid material 22, such as gypsum or wood, is provided for forming the ceiling 12.

Figure 3:
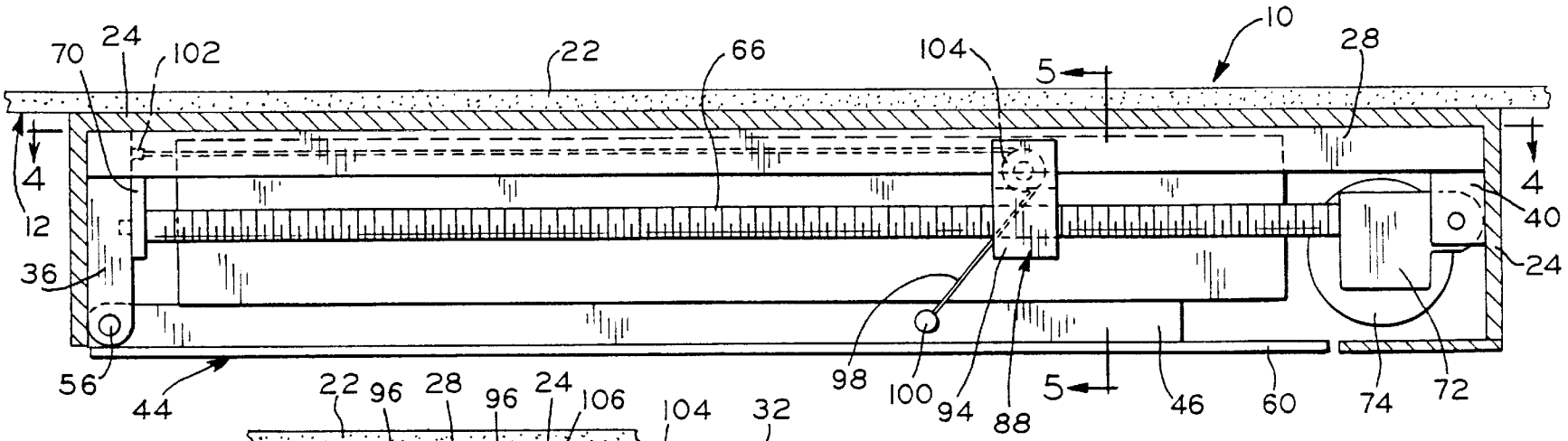
FIG. 3 is a cross sectional view similar to FIG. 2, except that the apparatus is depicted in a cabinet mounted in a ceiling and the door and television in the retracted storage position.

Apparatus 10 can be mounted on a ceiling by merely setting thereon as depicted in FIGS. 2 and 3, or can be attached to framing members and/or the visible ceiling. For example, as shown in FIG. 3, apparatus 10 is located within a cabinet 24 which is attached to the visible ceiling 12 made of a solid material such as gypsum, drywall or wood 22. As more fully described hereinbelow, apparatus 10 is constructed so as to be relatively thin for use with low ceiling heights, if necessary. Apparatus 10 can be used on many different ceiling applications, for example, in recreation vehicles, homes and commercial buildings, etc.

Figure 4:
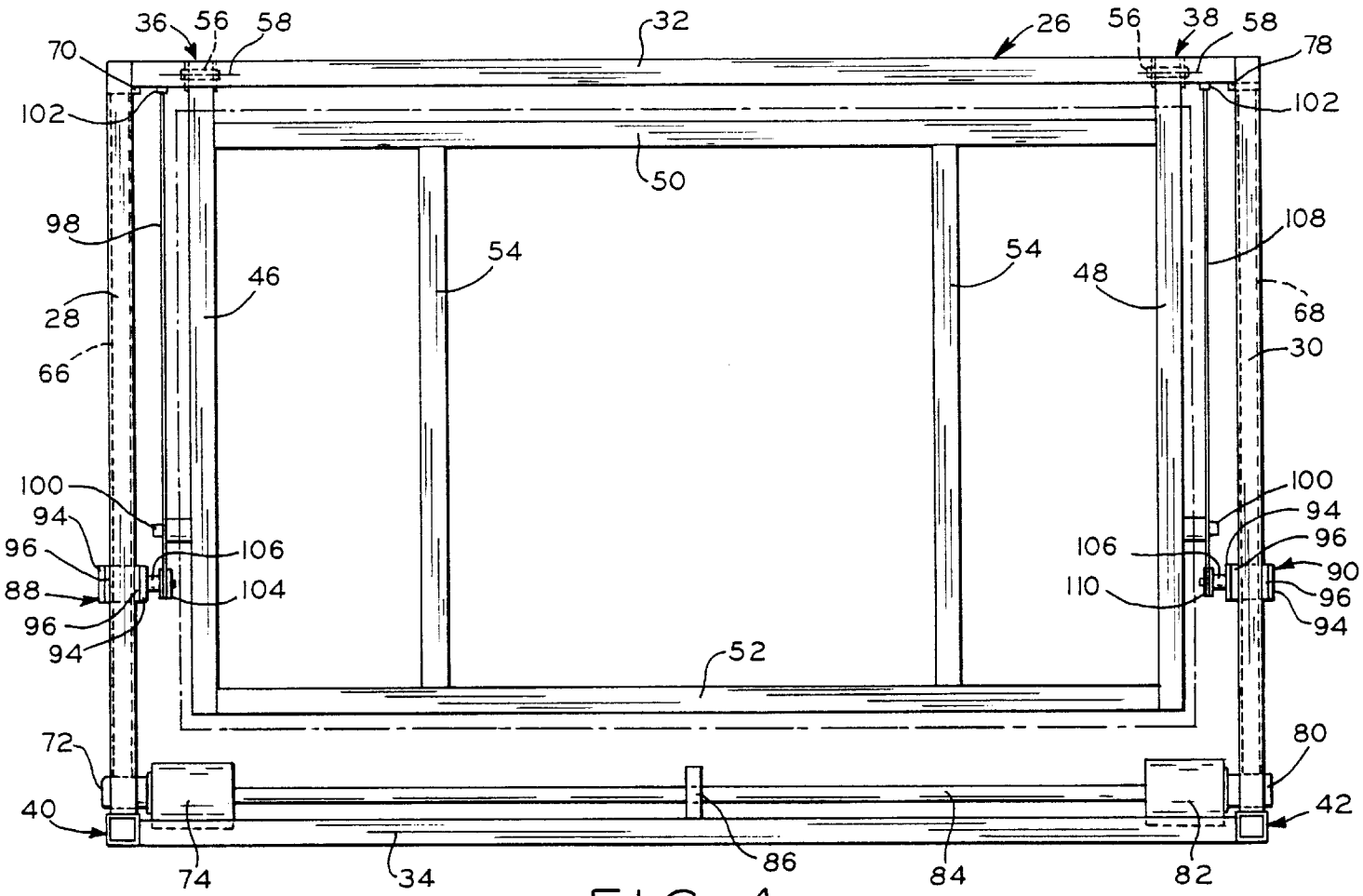
FIG. 4 is a cross sectional view of the apparatus taken generally along line 4—4 in FIG. 3; and, FIG. 5 is a cross sectional view of the apparatus shown in FIG. 3 taken generally along line 5—5.

Preferably, apparatus 10 is constructed having an upper generally rectangular frame 26 made up of left tube member 28, right tube member 30, back tube member 32, and front tube member 34. Tube members 28, 30, 32, and 34 are preferably made of steel or aluminum and are attached together by welding, fasteners or other suitable means. Left back leg 36 and right back leg 38 extend generally perpendicular downwardly from frame 26. Similarly, left front leg 40 and right front leg 42 extend generally perpendicular and downwardly from frame 26. Legs 36, 38, 40, and 42 are also preferably made of steel or aluminum tubing and are fixed to the frame 26 by welding, fasteners or other suitable means. As best seen in FIGS. 4 and 5, front legs 40 and 42 are attached to frame 26 at the intersections or connections of the front tube member 32 and left and right tube members 28 and 30, whereas the back legs 36 and 38 are attached to back tube member 32 slightly inwardly of the intersections or connections between the back tube member 32 and left and right members 28 and 30.

Figure 5:
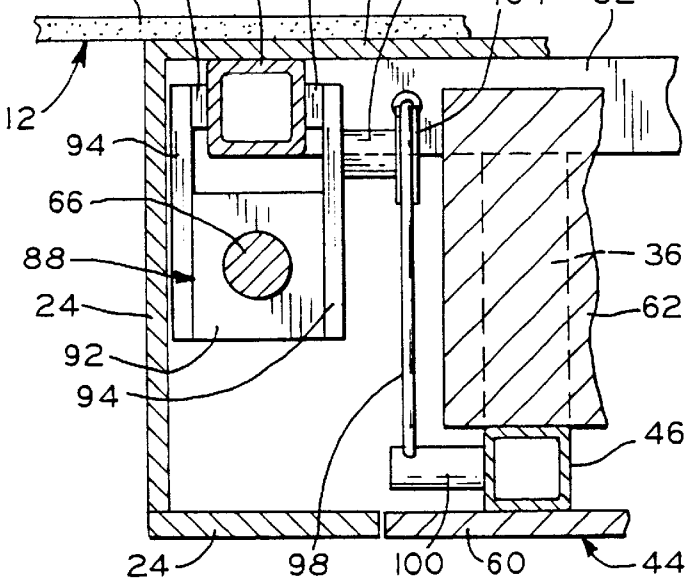

A door generally designated by the numeral 44 is pivotally mounted to left and right back legs 36 and 38 and is adapted to pivot between an extended viewing generally vertical position as shown in FIGS. 1 and 2, and a storage retracted generally horizontal position as shown in FIGS. 3 and 5. Door 44 is made up of a frame including left and right hinged tube members 46 and 48, back and front intermediate tube members 50 and 52, and rib tube members 54 extending between the intermediate members 50 and 52. The door frame tube members 46, 48, 50, 52 and 54 are also preferably made of steel or aluminum tubing and are secured together by welding, fasteners or other suitable means. As shown, left and right hinged tube members 46 and 48 are pivotally attached to respective left and right back leg members 36 and 38 with pins 56 for thereby allowing the door 44 to pivot about the generally horizontally disposed axis of rotation 58. A decorative door panel 60 is affixed to the door frame members as shown so as to pivot therewith. When door 44 is retracted to its storage position as shown in FIGS. 3 and 5, door panel 60 essentially closes the opening leading into the ceiling of FIGS. 1 and 2 or, where a cabinet is used as shown in FIGS. 3 and 5, closes the opening to the cabinet. Door panel 60 is constructed of a material and is provided with an outside and/or bottom face, so as to either match the ceiling or cabinet, or standout therefrom as may be desired.

A flat bed television 62 having a viewing screen 64 is mounted upon and carried by the frame of door 44 and is adapted to pivot therewith about the axis of rotation 58. Flat bed television 62 is relatively thin as shown and, thus, when door 44 is retracted, the flat bed television is located and fits above the ceiling 12 or, when a cabinet 24 is used, fits within the cabinet. In both embodiments, the door panel 60 conceals the rear wall of the flat bed television 62 and, when door 44 is retracted, the television screen 64 is generally horizontally disposed facing generally upwardly.

Left and right drive screws 66 and 68 are provided generally below and parallel to each of the left and right tube members 28 and 30. At one end, left drive screw 66 is rotatably supported by finger 70 extending downwardly from and attached to left tube member 28. At its other end, left drive screw 66 is supported by and adapted to be rotatably driven by a left gearing assembly 72 and electric motor 74. The left gearing assembly 72 and electric motor 74 are attached to the left front leg 40 with a pin fastener 76 or other suitable means. Similarly, the right drive screw 68 is rotatably supported by a finger 78 extending downwardly from and attached to the right tube member 30. At its other end, right drive screw 68 is supported by and rotatably driven by a right gearing assembly 80 and right electric motor 82. The right gearing assembly 80 and electric motor 82 are also similarly attached to the right front leg 42 with a pin fastener 76 (not shown). A coupling shaft 84 extends between left and right electric motors 74 and 82 and is attached to the drive shafts of each of the motors thereby mechanically coupling the left and right motors, as well as the respective gear assemblies and drive screws to which the electric motors are coupled. The coupling shaft 84 extends through a support bearing 86 which is attached to the left back leg member 36. As can be appreciated, support bearing 86 rotatably supports the coupling shaft 84 and prevents vibration thereof.

Electric motors 74 and 82 are selectively reversible and can be either AC or DC type depending on the specific application of the apparatus 10. As should now be appreciated, electric motors 74 and 82 are simultaneously energized and, because they are mechanically coupled and synchronized with coupling shaft 84, will always rotate the left and right drive screws 66 and 68 in the same rotational direction and speed. By reversing the electric motors 74 and 82, the drive screws 66 and 68 are caused to rotate in the opposite direction as desired.

A left drive nut assembly 88 threadingly engages the left drive screw 66, and a right drive nut assembly 90 threadingly engages the right drive screw 68. Left and right drive nut assemblies 88 and 90 are identical to one another and, as depicted in FIG. 5, include a nut 92 surrounding and threadingly engaging a respective drive screw 66 or 68. Arms 94 are attached to nut 92 and extend upwardly therefrom, whereat a nylon, high density plastic or other low friction material elements 96 are attached to each of the arms 94 sandwiching the respective left and right tube members 28 and 30. Accordingly, as drive screws 66 and 68 are rotated about their longitudinal axis, the drive nut assemblies 88 and 90 are prevented from rotating therewith by the arms 94 and friction elements 96. Furthermore, as the drive screws are rotated, the drive nut assemblies 88 and 90 travel longitudinally along the respective drive screws and left and right tube members 28 and 30. By simply controlling the rotational direction of the drive screws, the drive nuts 88 and 90 are selectively moveable along the drive screws between respective fingers 70 and 78 and gear assemblies 72 and 80. Preferably, drive screws 28 and 30 and the nuts 92 are provided with Acme type threads for maximizing travel and minimizing friction losses.

A left cable 98 is provided and, at one end, is attached to the left hinged tube member 46 with a pin fastener 100. At its other end, cable 98 is attached near the door pivotal connection 56 and, more precisely, is attached to back tube member 32 of frame 26 with a pin fastener 102. Cable 98 is preferably a braided wire type cable which is highly flexible but not elastic. The left drive nut assembly 88 further includes a left cable guide wheel 104 rotatably supported with a pin 106 which is attached to the inside arm 94 of the drive nut assembly 88. Left cable 98 extends over the left cable guide wheel 104 as shown. Similarly, a right cable 108 is provided and is attached, at one end, to right hinged tube member 48 with a pin 100 and, at its other end, is attached near the door pivotal connection and, more specifically, to the back tube member 32 of frame 26 with a pin fastener 102. Additionally, a right cable guide wheel 110 is provided and is rotatably supported on the right drive nut assembly 90 with a pin 106 which is attached to the inside arm 94 of the right drive nut assembly 90. Right cable 108 extends over the right guide wheel 110 as shown.

In operation, cable 98 is adapted to travel over the left guide wheel 104 and right cable 108 is adapted to travel over the right guide wheel 110. Accordingly, as best seen in FIGS. 2 and 3, as the drive nut assemblies 88 and 90 are selectively caused to move back and forth along respective drive screws 66 and 68, the cable length between the respective drive nut assembly guide wheels 104 and 110 and the cable to door connection at pin fasteners 100 is selectively increased and decreased. In this manner, as this cable length is increased, door 44 is lowered or extended to the viewing position as shown in FIGS. 1 and 2. When the drive nut assemblies are caused to travel along the drive screws toward the respective left and right gear assemblies 72 and 82, the cable lengths between the drive nut assembly guide wheels and pins 100 is decreased, thereby causing the door 44 to pivot upwardly and be retracted to a storage position as shown in FIG. 3. It is noted that, very advantageously, as the door 44 reaches its fully retracted or closed position, the left and right drive nut assemblies 88 and 90 are caused to travel sufficiently far enough from fingers 70 and 78 so as to be generally vertically above the pin fasteners 100. In this manner, the pulling force being applied by the cables 98 and 108 are directed generally vertically upwardly and, thus, efficiently pull door 44 upwardly to its final retracted storage position. As should now be appreciated the apparatus 10 functions to efficiently selectively retract the flat bed television 62 to a stored position as shown FIG. 3 and to extend the door 44 and television 62 to a viewing position as shown in FIGS. 1 and 2.

While the invention has been described as having specific embodiments, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. An apparatus for selectively retracting a television to a stored position and extending the television to a viewing position comprising:

a door mounted for pivoting between a retracted storage position and an extended viewing position;

a television being carried on said door;

a drive nut threadingly engaging a drive screw;

said drive screw being selectively rotatable for thereby causing said drive nut to travel along said drive screw; and, a cable cooperating with said door and said drive nut for selectively pivoting said door and television between said retracted storage position and said extended viewing position.

2. The apparatus of claim 1 wherein said cable extends over said drive nut for selectively pulling and releasing said cable as said nut travels along said drive screw for thereby pivoting said door between said retracted storage position and said extended viewing position.

3. The apparatus of claim 1 further comprising a cable guide wheel attached to said drive nut, said cable extending over said guide wheel for selectively pulling and releasing said cable as said drive nut and guide wheel travel along said drive screw for thereby pivoting said door between said retracted storage position and said extended viewing position.

4. The apparatus of claim 1 further comprising an electric motor coupled to said drive screw for selectively rotatably driving said drive screw.

5. The apparatus of claim 1 wherein said door is pivotally mounted for selectively retracting said television into a ceiling and extending said television generally downwardly and out of said ceiling.

6. The apparatus of claim 1 wherein said door is pivotally mounted for selectively retracting said television into a cabinet and extending said television generally downwardly and out of said cabinet.

7. The apparatus of claim 1 wherein said television is a flat bed television and said door and flat bed television are placed in a generally horizontal position when retracted and placed in a generally vertical position when extended for viewing.

8. The apparatus of claim 1 wherein said cable is attached at one end to said door and at its other end is attached near a door pivotal connection, and extends over said drive nut, and wherein the cable length between said drive nut and said cable and door connection is decreased as said door is pivoted to its retracted position.

9. The apparatus of claim 1 wherein said cable is attached at one end to said door and at its other end is attached near a door pivotal connection and extends over a cable guide wheel attached to said drive nut, and wherein the cable length between said cable guide wheel and said cable and door connection, is decreased as said door is pivoted to its retracted position.

10. An apparatus for selectively retracting a television to a stored position and extending the television to a viewing position comprising:

a door having a left side, a right side and an upper side, said door mounted along said upper side for pivoting between a retracted storage position and an extended viewing position;

a television being carried on said door;

a left drive nut threadingly engaging a left drive screw and a right drive nut threadingly engaging a right drive screw;

said left and right drive screws being selectively rotatable for thereby causing said respective drive nuts to travel along said drive screws; and, a left cable attached to said door generally near said door left side and a right cable attached to said door generally near said door right side, said left cable cooperating with said left drive nut and said right cable cooperating with said right drive nut for selectively pivoting said door and television between a retracted storage position and an extended viewing position.

11. The apparatus of claim 10 wherein said left cable extends over said left drive nut and said right cable extends over said right drive nut for selectively pulling and releasing said cable as said left and right drive nuts travel along said respective left and right drive screws for thereby pivoting said door between said retracted storage position and said extended viewing position.

12. The apparatus of claim 10 further comprising a left cable guide wheel attached to said left drive nut, said left cable extending over said left guide wheel for selectively pulling and releasing said cable as said left guide wheel and drive nut travel along said left drive screw; and, a right cable guide wheel attached to said right drive nut, said right cable extending over said right guide wheel for selectively pulling and releasing said right cable as said right guide wheel and right drive nut travel along said right drive screw, thereby pivoting said door and television between said retracted storage position and said extended viewing position.

13. The apparatus of claim 10 further comprising a first electric motor coupled to said left drive screw for selectively rotatably driving said left drive screw, and a second electric motor coupled to said right drive screw for selectively rotatably driving said right drive screw.

14. The apparatus of claim 13 further comprising a coupling shaft extending between and coupling and synchronizing said first and second electric motors to one another.

15. The apparatus of claim 10 wherein said door is pivotally mounted for selectively retracting said television into a ceiling and extending said television generally downwardly and out of said ceiling.

16. The apparatus of claim 10 wherein said door is pivotally mounted for selectively retracting said television into a cabinet and extending said television generally downwardly and out of said cabinet.

17. The apparatus of claim 10 wherein said television is a flat bed television and said door and flat bed television are placed in a generally horizontal position when retracted and placed in a generally vertical position when extended for viewing.

18. The apparatus of claim 10 wherein said left and right cables are attached at their other ends near a door pivotal connection and extend over respective left and right drive nuts, and wherein the cable lengths between said drive nuts and said cable and door connections are decreased as said door is pivoted to its retracted position.

19. The apparatus of claim 10 wherein said left and right cables are attached at their other ends near a door pivotal connection, said left cable extending over a left cable guide wheel attached to said left drive nut and said right cable extending over a right cable guide wheel attached to said right drive nut, and wherein the cable lengths between said respective left and right cable guide wheels and said cable and door connections are decreased as said door is pivoted to its retracted position.

20. The apparatus of claim 10 wherein said drive screws are provided with Acme threads.

* * * * *